United States Patent [19]

Brulé

[11] 4,374,015

[45] Feb. 15, 1983

[54] PROCESS FOR THE LIQUEFACTION OF COAL

[75] Inventor: Michael R. Brulé, Oklahoma City, Okla.

[73] Assignee: Kerr-McGee Corporation, Oklahoma City, Okla.

[21] Appl. No.: 241,578

[22] Filed: Mar. 9, 1981

[51] Int. Cl.[3] ..... C10G 1/00; C10G 1/06

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 3,018,241 | 1/1962 | Gorin | 208/8 |
| 3,640,816 | 2/1972 | Bull et al. | 208/10 |
| 4,070,268 | 1/1978 | Davis et al. | 208/8 LE |
| 4,119,524 | 10/1978 | Leonard et al. | 208/8 LE |
| 4,123,347 | 10/1978 | Maa | 208/8 LE |
| 4,134,821 | 1/1979 | Gorin | 208/8 |
| 4,162,956 | 7/1979 | Rhodes | 208/8 LE |
| 4,189,371 | 2/1980 | Maa et al. | 208/8 LE |
| 4,244,812 | 1/1981 | Baldwin et al. | 208/8 LE X |
| 4,283,267 | 8/1981 | Maa et al. | 208/10 X |
| 4,297,200 | 10/1981 | Briley | 208/8 LE X |
| 4,300,996 | 11/1981 | Kuehler | 208/8 LE X |
| 4,338,183 | 7/1982 | Gatsis | 208/10 |

OTHER PUBLICATIONS

"Coal Liquefaction", EPRI Journal, pp. 38–39, (Sep. 1979).

*Primary Examiner*—Delbert E. Gantz
*Assistant Examiner*—William G. Wright
*Attorney, Agent, or Firm*—William G. Addison

[57] ABSTRACT

A process for producing and then separating distillable and substantially non-distillable coal liquefaction products into various fractions employing a series of extraction solvents. At least one fraction comprises a portion of the non-distillable coal liquefaction products and is suitable for use as a coal solvent, either with or without additional hydrotreating, in the coal liquefaction process. In one embodiment, the coal liquefaction products are contacted with a cascade of extraction solvents, having successively fewer carbon atoms in their molecular structure, at elevated temperatures and pressures to separate the products into various fractions. In another embodiment the coal liquefaction products are contacted with a cascade of extraction solvents, having an increasing number of carbon atoms in their molecular structure, at elevated temperatures and pressures to separate the products into various fractions.

21 Claims, 2 Drawing Figures

PROCESS FOR THE LIQUEFACTION OF COAL

BACKGROUND OF THE INVENTION

1. Field of the Invention

This invention relates to a process for producing and fractionating goal liquefaction products to recover selected compounds for use in the process, and more particularly, to those processes in which a coal-derived solvent is used to dissolve coal in a coal liquefaction zone to yield both distillable and substantially nondistillable coal liquefaction products from which distillable and substantially nondistillable compounds can be separated for use as solvent.

2. Description of the Prior Art

It is known to convert particulate raw coal to coal liquefaction products through the use of distillable coal-derived solvents.

Typically, the particulate raw coal is admixed with the distillable coal-derived solvent to form a slurry which is heated in the presence of hydrogen gas for from about 15 minutes to several hours to a temperature above 850° F. while maintained at a pressure of from 1000 to 5000 psig. to form distillable and substantially nondistillable coal liquefaction products. Recently, it has been found that the liquefaction process can occur quite rapidly at milder reaction conditions than formerly considered necessary. For example, it has been found that over 90 percent of the organic components of a coal in a slurry with a distillable coal-derived solvent can be converted to liquefaction products by heating the slurry for from 1 to 5 minutes at a temperature of from about 800° to 850° F. and a pressure of from about 1200 to 2500 psig. However, it also has been found that at such short reaction times of 1 to 5 minutes a substantial portion of the distillable coal-derived solvent combines with the coal or initial liquefaction products to form a nondistillable product that is unsuitable for reuse as solvent in the liquefaction process. While a portion of the products produced by the liquefaction process comprise the same components as the distillable coal-derived solvent, they are produced in an insufficient amount to replace all of the solvent that is lost through combination with the coal during the liquefaction process. Thus, the coal can be converted under mild reaction conditions but a continuous process would not be possible without the introduction of additional quantities of the distillable coal-derived solvent into each liquefaction process cycle to make up the loss from the previous cycle. Such operation is economically undesirable.

Recently, it also has been found that a portion of the substantially nondistillable coal liquefaction products produced during the liquefaction process comprise compounds that have chemical functionalities typical of the types found in the distillable coal-derived solvents. The potential role of these compounds in a coal liquefaction process has only recently been appreciated.

A theory now has evolved which suggests that these substantially nondistillable coal liquefaction products, which have relatively high boiling point temperatures, also have unique hydrogen transferring abilities similar to those of distillable coal-derived solvents which have a lower boiling temperature and that such products can be used as solvent in the liquefaction process to improve the yield and quality of the process products. The ability to recover these substantially nondistillable compounds from the coal liquefaction products along with the distillable coal-derived solvent provides a means for supplying substantially all of the solvent necessary for continuous short reaction time liquefaction processes.

It is desirable to develop procedures by which the substantially nondistillable coal liquefaction products which exhibit chemical functionalities similar to those of distillable coal-derived solvents can be separated from the coal liquefaction products to permit their use as solvent in coal liquefaction processes.

SUMMARY OF THE INVENTION

The present invention provides a procedure for separating distillable and substantially nondistillable coal-derived compounds from coal liquefaction products for use as solvent in a coal liquefaction process.

In the practice of this invention, particulate raw coal is contacted with a solvent that is at least partially distillable in a coal liquefaction zone maintained at an elevated temperature and pressure to effect at least a partial conversion of the coal to distillable and nondistillable coal liquefaction products. The coal liquefaction products and solvent then may be introduced into a distillation zone. In the distillation zone, at least a portion of the distillable portion of the coal liquefaction products and solvent are separated from the substantially nondistillable products. The distillable products are recovered and that portion comprising solvent can be recycled in the process. Thereafter, at least a portion of the remainder, which includes the insoluble or undissolved residue from the liquefaction of the coal, is subjected to a cascaded solvent extraction operation. Alternatively, the coal liquefaction products can be introduced directly into the extraction apparatus without distillation.

In one embodiment, the extraction operation separates the insoluble or undissolved residue from the coal liquefaction products to produce at least a substantially solids-free product. Then, the substantially solids-free product is contacted with a series of extraction solvents having a decreasing number of carbon atoms to separate the substantially solids-free product into various coal fractions and produce at least one substantially nondistillable fraction at least a portion of which comprises compounds which possess the chemical functionalities typical of those types found in distillable coal-derived solvents. This select fraction then is recycled in the process to supplant a portion of the distillable solvent necessary for the liquefaction process. The separations are effected by maintaining the various mixtures of coal liquefaction products and extraction solvents at elevated temperatures and pressures.

Further, the substantially nondistillable fraction can be hydrogenated prior to recycle to the coal liquefaction process. Whether or not the substantially nondistillable fraction is hydrogenated prior to use as solvent in the liquefaction process depends upon the conditions of the coal liquefaction process and the desired properties of the coal liquefaction products.

In an alternate embodiment of the present invention, the coal liquefaction products, whether or not having been subjected to distillation, are contacted with successively heavier extraction solvents as measured by an increasing number of carbon atoms to separate successively heavier fractions of the coal liquefaction products from the mixture of insoluble residue and coal liquefaction products. The separations are effected by maintaining the various admixtures of coal liquefaction products and extraction solvents at elevated temperatures and pressures. Such practice also permits the production of at least one substantially nondistillable fraction at least a portion of which comprises compounds which possess the chemical functionalities typical of those types found in distillable coal solvents. This substantially nondistillable fraction, either with or without additional hydrogenation, can be recycled in the liquefaction process for use as solvent to supplant a portion of the distillable solvent.

DESCRIPTION OF THE PREFERRED EMBODIMENT

Figure 1:
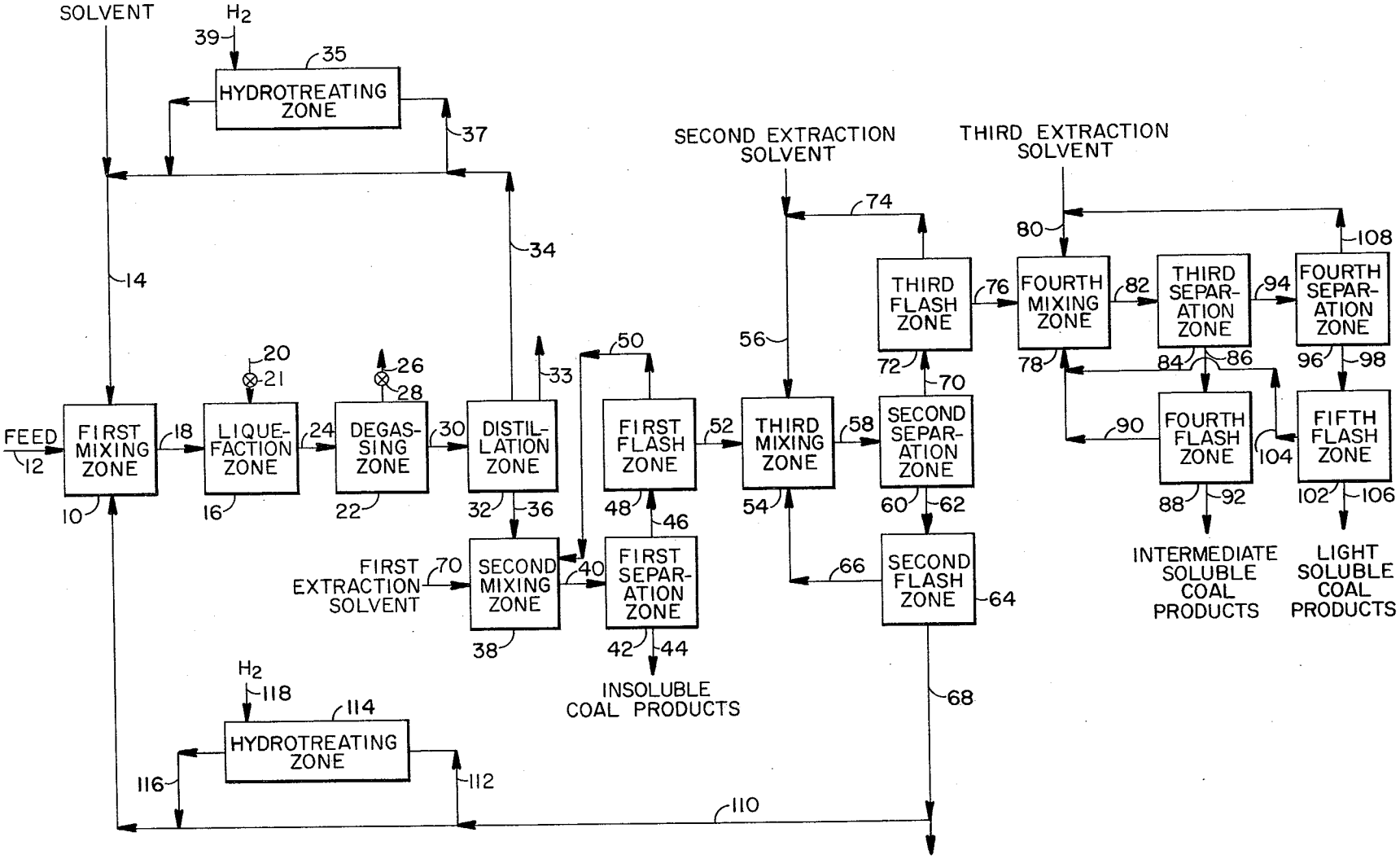
FIG. 1 is a diagrammatic illustration of one embodiment of the process of this invention.

Turning now to FIG. 1, a coal feed to be processed in accordance with this invention is contacted with a solvent that is at least partially distillable in a first mixing zone 10. The term "coal feed" as used herein refers to pulverized raw coal and any other fractions obtained in the conversion of raw coal or the like into upgraded products. The coal feed is passed to the first mixing zone 10 through a conduit 12. The solvent enters the first mixing zone through a conduit 14. Sufficient solvent is introduced into first mixing zone 10 to provide a solvent to feed ratio by weight of from 0.25:1 to about 5:1. Larger quantities of the solvent can be used.

The original solvent may be any one of a wide variety of coal solvents used in the art including both hydrogen donor solvents, nonhydrogen donor solvents and mixtures thereof which are fluid under the temperature and pressure conditions of the process. The solvent can consist of both distillable and nondistillable components. Preferably, the distillable portion of the solvent has the same composition as a distillable fraction of the coal liquefaction products which are to be produced. Preferably, the distillable fraction comprises hydrocarbons having a boiling range of from about 400° F. to about 975° F. Examples of other suitable solvents are tetralin, biphenyl, methylnapthalene, tetrahydroquinoline, dihydrophenanthrene and the like. Other types of coal solvents may be added to the above-mentioned types for special reasons, however, the resulting mixture should be predominately of the types mentioned. It will be understood, of course, that as the solvent is recycled in the process that the original solvent ultimately will be consumed and replaced by a coal derived solvent of differing composition containing both distillable and nondistillable components which exhibit functionalities of the chemical types found in the original solvent.

In first mixing zone 10, the coal feed and solvent are agitated with a stirring mechanism (not shown) at about ambient temperature and pressure to form a slurry. The slurry then is introduced into a hydroextraction or liquefaction zone 16 through a conduit 18.

In one embodiment, hydrogen gas, synthesis gas mixtures or mixtures of water and carbon monoxide can be introduced into the slurry in liquefaction zone 16 through a conduit 20, from a source not shown, a valve 21 interposed therein to control the flow. A hydrotreating catalyst also may be added, if desired. Where a catalytic process is used, liquefaction zone 16 preferably contains an ebullated bed of catalyst. The catalyst size is selected to permit the particles of coal residue to pass readily upward through the interstices between the catalyst particles along with the liquids and gases.

Examples of hydrotreating catalysts which can be used in the coal liquefaction zone include those containing cobalt, molybdenum, nickel, tungsten, stannous chloride, iron oxide and any other hydrogenation catalyst capable of operation in the presence of sulfur-, nitrogen- and oxygen-containing coal feeds.

Suitable operating conditions for coal liquefaction zone 16 include a temperature of from about 500° F. to about 900° F., a hydrogen pressure of from about 0 to about 4000 psig. and a residence time of from about 30 seconds to several hours.

The mixture of coal liquefaction products comprising distillable and nondistillable products and insoluble residue, solvent and gases, if any, is withdrawn from liquefaction zone 16 and passed to a degassing zone 22 through a conduit 24. The mixture is degassed by permitting excess hydrogen, and any other gases or vapors to be discharged from degassing zone 22 through a conduit 26, a pressure reducing valve 28 being interposed therein to control the flow of the gases. Such gases may be recycled, after suitable purification, if desired, to liquefaction zone 16 to aid in converting additional coal feed. The degassed mixture then is withdrawn from degassing zone 22 and introduced into a distillation zone 32 through a conduit 30. The distillation zone 32 may comprise an atmospheric or vacuum distillation vessel. Alternatively, the degassed mixture may be introduced directly into the solvent extraction process to be described hereafter.

The coal liquefaction process hereinbefore described has been cited merely to illustrate some of the available means of coal conversion and it therefore is not intended to limit the scope of the invention to those particular means. The process of the present invention would be equally applicable to any other hydroextraction technique which yields distillable and nondistillable coal products.

In the process of liquefying the raw coal, some of the solvent often is consumed, altered or otherwise reacted such that it is combined with a portion of the high molecular weight residue of the coal liquefaction products and it can not be recovered by thermal distillation. Such solvent is sometimes called "polymerized solvent."

In some conversion schemes, particularly those in which a large portion of the coal is converted to distillate fractions, solvent is produced as a distillate product of the process in excess of the amount of solvent consumed. Such schemes are self-sustaining in terms of requirements for liquefaction solvent.

In other coal conversion schemes, such as short reaction time or low hydrogen consumption processes in which the solvent is combined with the coal or initial coal liquefaction products, the solvent can not be recovered by thermal distillation in sufficient quantity to provide a self-sustaining process. In a process such as the latter, the distillation zone is operated to substantially separate the recoverable solvent from the coal liquefaction products. The separated solvent is withdrawn from distillation zone 32 through a conduit 34 for recycle in the process. Alternatively, some or all of the withdrawn solvent in conduit 34 can be introduced into a hydrotreating zone 35, prior to recycle, through a conduit 37 connected to conduit 34. The hydrotreating operation replaces hydrogen in the solvent that was consumed during the coal liquefaction process. Generally, the amount of solvent that is removed from the coal liquefaction products is in the range of from about 15 to about 100 percent of the solvent retained in the liquefaction products which is potentially recoverable by thermal distillation. Preferably, the amount of solvent removed will be in the range of from 30 to 95 percent.

In hydrotreating zone 35, the solvent can be enriched in hydrogen donor components with hydrogen introduced into zone 35 through a conduit 39. However, the enriched solvent is not produced in sufficient quantity to replace the solvent which is lost to the process during the liquefaction of the raw coal. Additional solvent may be introduced from an external source (not shown) into liquefaction zone 16 to replace a portion of the lost solvent. However, such addition is not desirable as it results in a substantially less economical process.

The present invention is especially useful when the coal liquefaction process is conducted under relatively mild conditions which are conducive to causing the development of a solvent deficiency when distillation alone is used to recover solvent for recycle. It has been found that certain substantially nondistillable compounds produced in the coal liquefaction process exhibit chemical functionalities typical of the types found in distillable coal-derived solvent. These compounds also have been found to be heat labile. If an attempt is made to recover these heat labile compounds by high temperature vacuum or atmospheric distillation, they are readily changed or modified into materials which are unsatisfactory for use as solvent.

In one preferred embodiment, distillation zone 32 comprises a single stage flash vessel into which the coal liquefaction products are introduced to separate at least a portion of the distillable solvent and any volatile coal liquefaction products merely by flash vaporization and without the use of a reboiler. A reboiler normally is employed in conventional atmospheric or vacuum distillation vessels to assist in the distillation process. The flash distillation avoids unnecessary heating of the heat labile compounds in the coal liquefaction products. Conventional atmospheric or vacuum distillation can be used, if sufficiently low temperatures are employed to avoid undesirable changes in the heat labile compounds.

Any net distillable coal liquefaction products that are separated in distillation zone 32 are withdrawn through a conduit 33 and a portion of the distillable coal liquefaction products can be treated by methods well known to those skilled in the art to fractionate the distillable products to produce select fractions for use as extraction solvent (to be hereinafter described) in the process.

The bottoms product remaining in distillation zone 32, after removal of at least a portion of the distillable solvent and coal liquefaction products, then is treated by the process of the present invention to separate the bottoms product into several soluble coal product fractions through the use of successive extraction solvents having a decreasing number of carbon atoms. At least one of the fractions that can be separated by the practice of this invention has been found to be suitable for use as solvent to supplant a portion of the distillable solvent employed to produce the coal liquefaction products.

In accordance with the process of this invention, the bottoms product is introduced into a second mixing zone 38 through a conduit 36. In mixing zone 38 the bottoms product is admixed with a first extraction solvent introduced through a conduit 70 to facilitate separation of the insoluble residue. Sufficient first extraction solvent is introduced into second mixing zone 38 to provide a ratio by weight of extraction solvent to coal liquefaction products in the mixture of from about 1:1 to about 10:1. Larger quantities of extraction solvent can be used, but such quantities are unnecessary. Thereafter, the mixture is withdrawn from mixing zone 38 and introduced into a first separation zone 42 through a conduit 40. The primary function of first separation zone 40 is to selectively and controllably separate the bottoms product into at least a substantially solids-free coal liquefaction product and a heavier high solids-containing product.

In an alternate embodiment of the present invention (not shown), the bottoms product remaining in distillation zone 32 is introduced directly into first separation zone 40 without prior admixing with the extraction solvent. In this instance, the first extraction solvent also is introduced directly into first separation zone 40 to contact and admix with the bottoms product and the mixture then is separated into the low solids-containing and high solids-containing products.

The first extraction solvent comprises a polycyclic aromatic hydrocarbon containing at least one less carbon atom than the liquefaction solvent. Preferably the aromatic hydrocarbon has a critical temperature above 700° F. Most preferably the first extraction solvent comprises a polycyclic aromatic hydrocarbon containing at least two fused benzene rings. The carbon atoms in the benzene rings can be substituted with oxygen, nitrogen and sulfur atoms. Specific examples of extraction solvents include fused ring aromatic hydrocarbons containing two, three, four and five fused benzene rings such as tetralin, fluorene, acenaphthene, phenanthene, pyrene, chrysene, perylene, and alkylated and substituted benzologs. The first extraction solvent also can comprise a separated fraction of the net distillable coal liquefaction products separated in distillation zone 32 or any of the other fluids hereinafter defined as extraction solvents.

In first separation zone 42, the mixture is caused to separate into a light phase comprising substantially solids-free coal liquefaction products and first extraction solvent and a heavy phase comprising insoluble residue and some first extraction solvent by control of the conditions of temperature and pressure within first separation zone 42.

The particular conditions of temperature and pressure maintained within first separation zone 42 are such that the reduced temperature of the first extraction solvent ($T_r$) is greater than about 0.7 and the reduced pressure of the first extraction solvent ($P_r$) is greater than about 0.4 wherein $T_r$ and $P_r$ are defined by the following equations:

$$T_r = T/T_c$$

$$P_r = P/P_c$$

where:

T = the absolute temperature at which the extraction solvent is maintained within the separation zone;

$T_c$ = the absolute critical temperature of the extraction solvent;

P = the absolute pressure at which the extraction solvent is maintained within the separation zone;

$P_c$ = the absolute critical pressure of the extraction solvent.

Any convenient units of temperature and pressure may be employed to calculate $T_r$ and $P_r$ provided that the same absolute units are used for T as for $T_c$ and P as for $P_c$.

In a preferred embodiment of the invention the temperature and pressure within first separation zone 42 are maintained such that the reduced temperature is in the range of from about 0.7 to about 1.5 and the reduced pressure is in the range of from about 0.4 to about 10.0. Most preferably, the conditions are maintained such that the reduced temperature is in the range of from about 0.8 to about 1.25 and the reduced pressure is in the range of from about 0.4 to about 5.0.

The heavy phase is withdrawn from separation zone 42 through a conduit 44. The heavy phase can be introduced into a steam stripper (not shown) or other appropriate apparatus to recover the first extraction solvent, and any other separable coal products which may be present, from the insoluble residue.

The substantially solids-free coal liquefaction products in the light phase separated in separation zone 42 generally can be described as an amorphous mixture of polycyclic aromatic hydrocarbons. The polycyclic aromatic hydrocarbons include substantially nondistillable coal-derived compounds comprising heat liable high boiling temperature homocyclics and heterocyclics containing nitrogen, oxygen and sulfur. Some of the substantially nondistillable compounds possess chemical functionalities similar to the types found in lower boiling temperature coal derived solvents.

The light phase is withdrawn from first separation zone 42 through a conduit 46 and introduced into a first flash zone 48. The light phase is reduced in pressure by flashing to produce at least one overhead stream comprising first extraction solvent and another first extraction solvent-lean stream comprising substantially solids-free coal liquefaction products. The first extraction solvent stream is withdrawn from first flash zone 48 through a conduit 50 for recycle to second mixing zone 38. The substantially solids-free coal liquefaction products are withdrawn from first flash zone 48 through a conduit 52 and introduced into a third mixing zone 54.

In third mixing zone 54 the substantially solids-free coal liquefaction products are contacted and admixed with a second extraction solvent introduced through a conduit 56. The second extraction solvent is introduced in sufficient quantity to permit the subsequent separation of the coal liquefaction products into at least two fractions.

Normally, the second extraction solvent is added in sufficient quantity to provide a ratio by weight of solvent to coal liquefaction products of from about 2:1 to about 10:1. Larger quantities of the second extraction solvent can be used, but such use is uneconomical. The mixture then is introduced into a second separation zone 60 through a conduit 58. The second extraction solvent comprises a fluid containing at least one less carbon atom than the first extraction solvent and preferably contains at least one less benzene ring. The carbon atoms can be substituted with oxygen, nitrogen and sulfur atoms. Specific examples of solvents include toluene, tetrahydrofuran, o-, m- and p-cresol, phenol, pyridine, mesitylene, quinoline and o-, m- and p-xylene. The second extraction solvent also can comprise a member of the group hereinafter defined as the third extraction solvent.

In an alternate embodiment of the present invention (not shown), the coal liquefaction products withdrawn from first flash zone 48 can be passed directly into second separation zone 60 without prior admixing with the second extraction solvent. In this instance, the second extraction solvent also is introduced directly into second separation zone 60 to form the mixture which is to be separated.

In second separation zone 60, the mixture is separated into at least two fractions; a second heavy phase comprising heavy components of the coal liquefaction products including some substantially nondistillable coal-derived compounds comprising heat labile homocyclics and heterocyclics and some second solvent and a second light phase comprising the remainder of the mixture. The term "heavy" being a relative term and meaning that the separated component or components generally have a molecular weight greater than the average of the remaining components from which a separation has been effected. The separation is effected within second separation zone 60 by maintaining the mixture at an elevated temperature and pressure level.

The particular conditions within second separation zone 60 are maintained such that the reduced temperature of the second extraction solvent is greater than about 0.7 and the reduced pressure is greater than about 0.4. Preferably, the reduced temperature of the second extraction solvent in zone 60 is in the range of from about 0.7 to about 1.5 and most preferably in the range of from about 0.8 to about 1.25. Preferably, the reduced pressure of the second extraction solvent in zone 60 is in the range of from about 0.4 to about 10.0 and most preferably in the range of from about 0.4 to about 5.0.

The second heavy phase is withdrawn from second separation zone 60 through a conduit 62 and introduced into a second flash zone 64. The second heavy phase is flashed within zone 64 to produce at least one overhead stream comprising second extraction solvent and one other stream comprising the heavy coal liquefaction products. The second extraction solvent stream is withdrawn from flash zone 64 through a conduit 66 and recycled to third mixing zone 54 to contact additional coal liquefaction products. The heavy coal liquefaction products are withdrawn from flash zone 64 through a conduit 68 for recovery. At least a portion of the heavy coal liquefaction products can be withdrawn from conduit 68 through a conduit 110 and introduced into first mixing zone 10 to provide a portion of the solvent necessary to liquefy the coal feed.

In some circumstances, depending upon the operating conditions selected for the coal liquefaction process and the desired properties of the coal liquefaction products, it is desirable to hydrotreat at least a portion of the heavy coal liquefaction products before use as solvent. If a portion of the heavy coal liquefaction products in conduit 110 are to be hydrotreated, that portion to be hydrotreated is withdrawn from conduit 110 and introduced into a hydrotreating zone 114 through a conduit 112.

In hydrotreating zone 114, which can include a catalyst, the heavy coil liquefaction products including the substantially nondistillable compounds comprising heat labile homocyclics and heterocyclics are hydrogenated to increase the hydrogen donor capability of at least a portion of the heavy coal liquefaction products. The hydrotreating conditions are maintained at a level which does not result in undesirable changes in the heat labile compounds. Such operation with regard to heat labile compounds is well within the skill of the art. In the event catalysts are employed, they may comprise any of the conventional petroleum hydrodeheterocycling catalysts. Hydrogen is introduced into hydrotreating zone 114 through a conduit 118. The hydrotreated heavy soluble coal products are withdrawn through a conduit 116 for introduction into first mixing zone 10.

It has been found that the recycle of a portion of the heavy coal liquefaction products which include the select substantially nondistillable compounds to supplant a portion of the distillable solvent enhances the overall effectiveness of the liquefaction solvent in dissolving the coal and promoting hydrogen transfer thereto. This permits the liquefaction process to be operated at a lower temperature and pressure than conventional processes employing distillable coal-derived solvents.

The second light phase is withdrawn from second separation zone 60 and introduced into a third flash zone 72 through a conduit 70. In third flash zone 72, the second light phase is flashed to produce at least one overhead stream comprising second extraction solvent and one other stream comprising second solvent-lean coal liquefaction products. The second extraction solvent stream is withdrawn from third flash zone 72 through a conduit 74 for recycle to third mixing zone 54. The remaining coal liquefaction products are withdrawn through a conduit 76 and introduced into a fourth mixing zone 78.

In fourth mixing zone 78, the coal liquefaction products are contacted with a third extraction solvent introduced through a conduit 80. Normally, the third extraction solvent is present in sufficient quantity to provide a ratio by weight of solvent to coal liquefaction products of from about 2:1 to about 10:1. Larger quantities of the third extraction solvent can be used, but such use is uneconomical.

The third extraction solvent comprises a fluid containing at least one less carbon atom than the second extraction solvent and can include, for example, aromatic hydrocarbons having normal boiling points below 310° F., such as benzene and toluene; cycloparaffin hydrocarbons having normal boiling points below 310° F., such as cyclobutane, cyclopentane, cyclohexane and cycloheptane; open chain mono-olefin hydrocarbons having normal boiling points below 310° F., such as butene, pentene, hexene, heptene; open chain saturated hydrocarbons having normal boiling points below 310° F. such as methane, ethane propane, butane, pentane, hexane, heptane, and octane; and ethylene, carbon dioxide and the like. The third extraction solvent also can comprise a separated fraction of the net distillable coal liquefaction products separated in distillation zone 32.

The mixture of coal liquefaction products and third extraction solvent is withdrawn from fourth mixing zone 78 and introduced into a third separation zone 84. Third separation zone 84 is maintained at an elevated temperature level and pressure level.

The particular conditions without third separation zone 84 are maintained such that the reduced temperature of the third extraction solvent is greater than about 0.7 and the reduced pressure is greater than about 0.4. Preferably, the reduced temperature of the third extraction solvent in zone 84 is in the range of from about 0.9 to about 1.5 and most preferably in the range of from about 1.0 to about 1.25. Preferably, the reduced pressure of the third extraction solvent in zone 84 is in the range of from about 0.4 to about 10.0 and most preferably in the range of from about 0.4 to about 5.0.

The particular temperature and pressure conditions in third separation zone 84 are selected to cause the mixture within zone 84 to separate into a third light phase and a third heavy phase. In one embodiment, the third light phase comprises light coal liquefaction products and third extraction solvent and the third heavy phase comprises intermediate coal liquefaction products and some third extraction solvent. The term "light" being a relative term and meaning that the separated component or components generally have a molecular weight less than another separated component and the term "intermediate" meaning that the separated component or components generally have a molecular weight less than another separated component and greater than the average of the remaining components from which a separation has been effected.

The third heavy phase is withdrawn from third separation zone 84 through a conduit 86 and introduced into a fourth flash zone 88. In fourth flash zone 88, the third heavy phase is flashed to provide at least one overhead stream comprising third extraction solvent and one other stream comprising the intermediate coal liquefaction products. The overhead stream is withdrawn from flash zone 88 through a conduit 90 for recycle to fourth mixing zone 78. The separated intermediate coal liquefaction products fraction are withdrawn through a conduit 92 and recovered.

In one embodiment (not shown), a portion of the coal liquefaction products recovered from flash zone 78 can be admixed with the coal liquefaction products flowing through conduit 110 to vary the properties of the substantially non-distillable coal liquefaction products that are recycled to supplant the distillable solvent. If desired, a portion of this fraction also can be hydrotreated prior to introduction into first mixing zone 10.

The third light phase is withdrawn from third separation zone 84 through a conduit 94 and introduced into a fourth separation zone 96. In one embodiment, fourth separation zone 96 is maintained at a temperature level higher than the temperature level in third separation zone 84 and at a pressure level substantially no greater than the pressure level of third separation zone 84. More particularly, the conditions within fourth separation zone 96 are maintained such that the reduced temperature of the third extraction solvent is greater than about 0.7 and the reduced pressure is greater than about 0.4. Preferably the reduced temperature of the third extraction solvent in zone 96 is in the range of from about 0.95 to about 1.50 and most preferably in the range of from about 1.05 to about 1.25. Preferably, the reduced pressure of the third extraction solvent in zone 96 is in the range of from about 0.4 to about 10.0 and most preferably in the range of from about 0.4 to about 5.0.

The particular temperature and pressure conditions in fourth separation zone 104 are selected to cause the third light phase to separate into a fourth light phase comprising third extraction solvent and a fourth heavy phase comprising the light coal liquefaction products.

The fourth heavy phase is withdrawn from fourth separation zone 96 through a conduit 98 for introduction into a fifth flash zone 102. In fifth flash zone 102 the fourth heavy phase is flashed to produce at least one stream comprising the light coal liquefaction products. A second stream comprising third extraction solvent may be formed as an overhead product of flash zone 102. The third extraction solvent stream, if formed, is withdrawn from fifth flash zone 102 through a conduit 104 for recycle to fourth mixing zone 78 to contact additional coal liquefaction products. The light coal liquefaction products stream is withdrawn from fifth flash zone 102 for recovery. A portion of the light coal liquefaction products stream can be recycled either with or without hydrotreating to form a portion of the distillable solvent used in the liquefaction process to convert the raw coal feed to liquefaction products.

The recovered fractions of the coal liquefaction products can be used as separate fuels to various processes or as feedstock to hydrorefining processes to produce additional products for use in, for example, production of gasoline, lubricants or chemical process feedstocks.

In an alternate embodiment of the present invention (not shown), the second light phase separated in second separation zone 60 is introduced directly into third separation zone 84 without separation of the second extraction solvent or addition of the third extraction solvent. In this embodiment, third separation zone 84 is maintained at a temperature level above the temperature level of second separation zone 60 and at a pressure level substantially no greater than that of second separation zone 60.

The particular temperature and pressure conditions are selected to cause the mixture within zone 84 to separate into a third light phase and a third heavy phase. In this embodiment, the third light phase comprises some of the light coal liquefaction products and second extraction solvent and the third heavy phase comprises the intermediate coakl liquefaction products and some of the second extraction solvent.

The third heavy phase is withdrawn through conduit 86 and flashed to separate the second extraction solvent. The second extraction solvent then can be recycled to third mixing zone 54 to contact additional coal liquefaction products. The separated intermediate coal liquefaction products are recovered and a portion can be recycled for use as solvent as previously described.

The third light phase then can be introduced into fourth separation zone 96 for treatment as previously described to form a fourth light phase comprising second extraction solvent and a fourth heavy phase comprising the light coal liquefaction products. The fourth light phase also can be recycled to third mixing zone 54. The fourth heavy phase can be treated to separate any remaining second extraction solvent and recovered or recycled as previously described.

In yet another embodiment, whenever the same extraction solvent is present in at least two consecutive separation zones, an additional quantity of the extraction solvent can be introduced into the successive separation zone along with the light phase from the preceeding separation zone. The presence of the additional extraction solvent has been found, in some instances, to improve the subsequent separation effected in the successive separation zone.

To illustrate the process of the present invention, and not by way of limitation, the following examples are provided.

EXAMPLE I

A particulate coal feed comprising Kentucky No. 9 & 14 coal continuously is contacted with a solvent comprising a 500° F. to 900° F. boiling-range coal-derived hydrocarbon fraction in a ratio of solvent to feed of 2:1 and introduced into liquefaction zone 16 (see FIG. 1). The mixture is solubilized at a pressure level of about 1200 psig., a temperature level of about 825° F. and a space rate of 50 pounds per hour per cubic foot in the presence of hydrogen to produce liquefaction products.

The coal liquefaction products and solvent are introduced into distillation zone 32 wherein at least a portion of the solvent and distillable coal liquefaction products are separated from the remaining substantially nondistillable coal liquefaction products. The solvent is recycled to contact additional coal feed. The quantity of solvent recovered from the coal liquefaction products is less than that introduced into the liquefaction zone.

The substantially nondistillable coal liquefaction products are withdrawn from distillation zone 32, mixed with a first extraction solvent comprising quinoline in a ratio of 2 parts by weight of extraction solvent to one part by weight of coal liquefaction products. The mixture then is introduced into first separation zone 42. First separation zone 42 is maintained at a temperature level of about 800° F. and a pressure level of about 1000 psig. which corresponds to a reduced temperature of the first extraction solvent in first separation zone 42 of about 0.88 and a reduced pressure of the first extraction solvent of about 1.2. The control of the temperature and pressure conditions causes a separation of the mixture into a substantially solids-free product and a high solids-containing product. The substantially solids-free product is withdrawn from first separation zone 42, flashed to remove a substantial portion of the first extraction solvent and introduced into mixing zone 54.

In mixing zone 54, the substantially solids-free product is contacted with a second extraction solvent comprising cyclohexane in sufficient quantity to provide a ratio by weight of extraction solvent to coal liquefaction products of about 2:1 to form a mixture. The mixture then is introduced into second separation zone 60 which is maintained at a temperature level of about 475° F. and a pressure level of about 750 psig. These conditions correspond to a reduced temperature of the second extraction solvent of about 0.94 and a reduced pressure of the second extraction solvent of about 1.27. The control of the temperature and pressure conditions causes a separation of the mixture within second separation zone 60 into a second light phase and a second heavy phase. The second heavy phase comprising heavy coal liquefaction products and second extraction solvent is recovered and flashed to recover the second extraction solvent.

The second light phase is flashed to recover second extraction solvent therefrom and the remaining coal liquefaction products are contacted with a third extraction solvent comprising carbon dioxide in mixing zone 78 in sufficient quantity to provide a ratio by weight of extraction solvent to coal liquefaction products of about 2:1 to form another mixture. This mixture then is introduced into third separation zone 84 which is maintained at a temperature level of about 100° F. and a pressure level of about 700 psig. which corresponds to a reduced temperature of the third extraction solvent of about 1.02 and a reduced pressure of the third extraction solvent of about 1.6. The control of the temperature and pressure conditions causes a separation of the mixture within third separation zone 84 into a third light phase and a third heavy phase.

The third light phase is introduced into fourth separation zone 96 which is maintained at a temperature level above that maintained in third separation zone 84 (about 25° F. higher) to effect a separation of the third light phase into a fourth light phase and a fourth heavy phase. The fourth heavy phase comprising light coal liquefaction products and third extraction solvent is flashed to separate the extraction solvent and the light coal liquefaction products are recovered.

A portion of the recovered heavy coal liquefaction products are admixed with a portion of the light coal liquefaction products in a ratio by weight of 3:1 and the mixture is recycled to provide additional solvent for contacting the coal feed along with the distilled solvent.

The coal feed thereafter is solubilized, employing at least a portion of the substantially nondistillable coal-derived solvent of the present invention, to produce coal liquefaction products. The coal liquefaction products are produced in a yield comparable to that produced with the original solvent.

EXAMPLE II

Coal liquefaction products are prepared and separated as described in Example I. In this instance, a portion of the heavy coal liquefaction products are treated with hydrogen in the presence of a catalyst comprising nickel and molybdenum to produce a partially hydrogenated product in a quantity sufficient to supplant that solvent consumed during the liquefaction process. This product then is recycled to the liquefaction process and liquefaction products are produced in a yield which is comparable to that produced with the original solvent.

Figure 2:
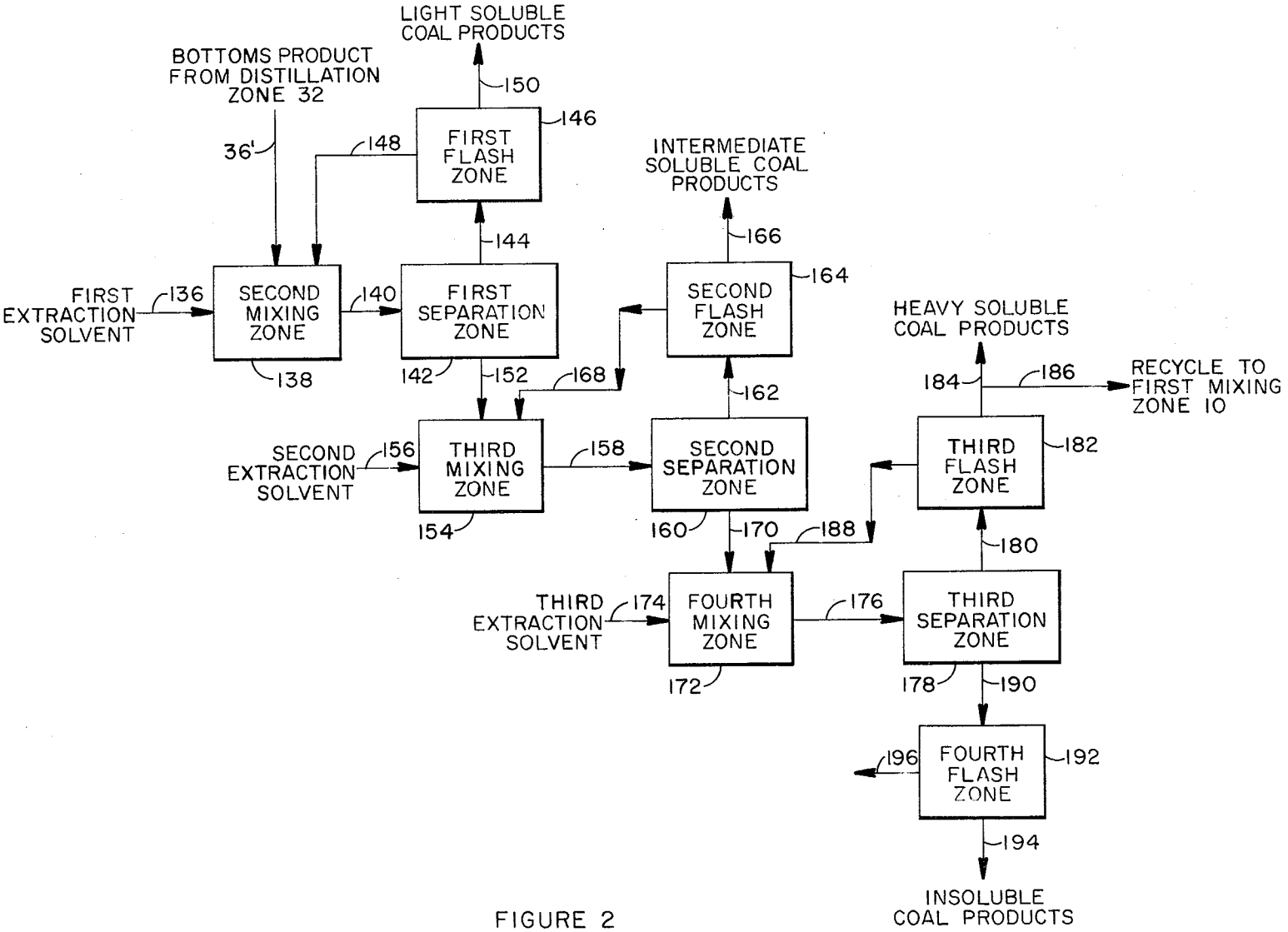
FIG. 2 is a diagrammatic illustration of an alternate embodiment of the process of this invention.

Referring now to FIG. 2, an alternate embodiment of the present invention is illustrated. In this particular embodiment, the bottoms product remaining in distillation zone 32, after removal of at least a portion of the distillable solvent and coal liquefaction products, is separated into various coal liquefaction product fractions employing successive extraction solvents having an increasing number of carbon atoms.

First, the bottoms product is introduced into a second mixing zone 138 through a conduit 36'. In mixing zone 138 the bottoms product is admixed with a first extraction solvent introduced through a conduit 136. Sufficient first extraction solvent is introduced into second mixing zone 138 to provide a ratio by weight of solvent to coal liquefaction products in the mixture of from about 2:1 to about 10:1. Larger quantities of extraction solvent can be used, but such quantities are unnecessary. Thereafter, the mixture is introduced into a first separation zone 142 through a conduit 140. The function of first separation zone 140 is to selectively and controllably separate the bottoms product into a substantially solids-free product comprising light coal liquefaction products and a heavier solids-containing product.

In an alternate embodiment of the present invention (not shown), the bottoms product remaining in distillation zone 32 is introduced directly into first separation zone 142 without prior admixing with the extraction solvent. In this instance, the first extraction solvent also is introduced directly into first separation zone 142 to contact and admix with the bottoms product and the mixture then is separated into the substantially solids-free and solids-containing products.

In this particular embodiment, the first extraction solvent comprises a fluid containing at least one less carbon atom and preferably at least one less benzene ring than the coal liquefaction solvent. The first extraction solvent can include, for example, aromatic hydrocarbons having normal boiling points below 310° F., such as benzene and toluene; cycloparaffin hydrocarbons having normal boiling points below 310° F., such as cyclobutane, cyclopentane, cyclohexane and cycloheptane; open chain mono-olefin hydrocarbons having normal boiling points below 310° F., such as butene, pentene, hexene, heptene; open chain saturated hydrocarbons having normal boiling points below 310° F. such as methane, ethane propane, butane, pentane, hexane, heptane, and octane; and ethylene, carbon dioxide and the like. The first extraction solvent also can comprise a separated fraction of the net distillable coal liquefaction products separated in distillation zone 32.

The particular conditions within first separation zone 142 are maintained such that the reduced temperature of the first extraction solvent is greater than about 0.7 and the reduced pressure is greater than about 0.4. Preferably, the reduced temperature of the first extraction solvent in zone 84 is in the range of from about 0.9 to about 1.5 and most preferably in the range of from about 1.0 to about 1.25. Preferably, the reduced pressure of the first extraction solvent in zone 84 is in the range of from about 0.4 to about 10.0 and most preferably in the range of from about 0.4 to about 5.0.

The particular temperature and pressure conditions in first separation zone 142 are selected to cause the mixture within zone 142 to separate into a first light phase comprising first extraction solvent and light coal liquefaction products and a first heavy phase. The first heavy phase comprises insoluble residue, the remaining coal liquefaction products and some first extraction solvent.

The first light phase is withdrawn from first separation zone 142 and introduced into a first flash zone 146 through a conduit 144. The first light phase is reduced in pressure by flashing to produce at least one overhead stream comprising first extraction solvent and another stream comprising light coal liquefaction products. The first extraction solvent stream is withdrawn from first flash zone 146 and passed through a conduit 148 for recycle to the second mixing zone 138 to provide at least a portion of the extraction solvent necessary to effect the subsequent separation of the coal liquefaction products in first separation zone 142. The light coal liquefaction products are withdrawn from first flash zone 146 through a conduit 150 and recovered as a product.

The first heavy phase is withdrawn from first separation zone 142 through a conduit 152 and introduced into a third mixing zone 154.

In third mixing zone 154 the first heavy phase is contacted and admixed with a second extraction solvent introduced through a conduit 156. The second extraction solvent is introduced in sufficient quantity to permit the subsequent separation of at least a portion of the remaining coal liquefaction products from the insoluble residue in the first heavy phase.

Normally, the second extraction solvent is added in sufficient quantity to provide a ratio by weight of solvent to coal liquefaction products of from about 2:1 to about 10:1. Larger quantities of the second extraction solvent can be used, but such use is uneconomical. The mixture then is introduced into a second separation zone 160 through a conduit 158. The second extraction solvent comprises a fluid containing at least one more carbon atom and preferably several more carbon atoms than the first extraction solvent and at least one less carbon atom and preferably several fewer carbon atoms than the coal liquefaction solvent. The carbon atoms can be substituted with oxygen, nitrogen and sulfur atoms. Specific examples of solvents include toluene, tetrahydrofuran, o-, m- and p-cresol, phenol, pyridine, mesitylene, quinoline, o-, m- and p-xylene.

In an alternate embodiment of the present invention (not shown), the first heavy phase can be introduced directly into second separation zone 160 without prior admixing with the second extraction solvent. In this instance, the second extraction solvent also is introduced directly into second separation zone 160 to form the mixture which is to separated.

In second separation zone 160, the mixture is separated into a second light phase comprising intermediate coal liquefaction products and second extraction solvent and a second heavy phase comprising insoluble residue, the remaining coal liquefaction products and some second extraction solvent. The separation is effected by maintaining the mixture at an elevated temperature and pressure level in second separation zone 160.

The particular conditions within second separation zone 160 are maintained such that the reduced temperature of the second extraction solvent is greater than about 0.7 and the reduced pressure is greater than about 0.4. Preferably, the reduced temperature of the second extraction solvent in zone 160 is in the range of from about 0.7 to about 1.5 and most preferably in the range of from about 0.8 to about 1.25. Preferably, the reduced pressure of the second extraction solvent in zone 160 is in the range of from about 0.4 to about 10.0 and most preferably in the range of from about 0.4 to about 5.0.

The second light phase is withdrawn from second separation zone 160 through a conduit 162 and introduced into a second flash zone 164. The second light phase is flashed within zone 164 to produce at least one overhead stream comprising second extraction solvent and one other stream comprising intermediate coal liquefaction products. The second extraction solvent stream is withdrawn from flash zone 164 through a conduit 168 for recycle to third mixing zone 154 to provide at least a portion of the second extraction solvent necessary to effect the subsequent separation of the first heavy phase in second separation zone 160. The intermediate coal liquefaction products are withdrawn from second flash zone 164 through a conduit 166 for recovery as a product.

The second heavy phase is withdrawn from second separation zone 160 through a conduit 170 and introduced into a fourth mixing zone 172.

In fourth mixing zone 172, the second heavy phase is contacted with a third extraction solvent. Normally, the third extraction solvent is present in sufficient quantity to provide a ratio by weight of solvent to coal liquefaction products of from about 1:1 to about 10:1. Larger quantities of the third extraction solvent can be used, but such use is uneconomical.

The third extraction solvent comprises a fluid containing at least one more carbon atom and preferably several more carbon atoms than the second extraction solvent and at least one less carbon atom and preferably several fewer carbon atoms than the coal liquefaction solvent. Preferably, the third extraction solvent is a polycyclic aromatic hydrocarbon having a critical temperature above 700° F. The carbon atoms can be substituted with oxygen, nitrogen and sulfur atoms. Specific examples of solvents include fused ring aromatic hydrocarbons containing two, three, four and five fused benzene rings such as tetralin, fluorene, acenaphthene, phenanthene, pyrene, chrysene, perylene and then alkylated and substituted benzologs. The third extraction solvent also can comprise a separated fraction of the net distillable coal liquefaction products separated in distillation zone 32 or any of the other fluids hereinafter desired as extraction solvents.

The mixture of second heavy phase and third extraction solvent is withdrawn from fourth mixing zone 172 through a conduit 176 and introduced into a third separation zone 178. Third separation zone 178 is maintained at an elevated temperature and pressure level to effect a separation of the mixture therein into a third light phase comprising heavy coal liquefaction products and third extraction solvent and a third heavy phase comprising insoluble residue and some third extraction solvent.

The particular conditions within third separation zone 178 are such that the reduced temperature of the third extraction solvent is greater than about 0.7 and the reduced pressure is greater than about 0.4. Preferably, the reduced temperature of the third extraction solvent in zone 178 is in the range of from about 0.7 to about 1.5 and most preferably in the range of from about 0.8 to about 1.25. Preferably, the reduced pressure of the third extraction solvent in zone 178 is in the range of from about 0.4 to about 10.0 and most preferably in a range of from about 0.4 to about 5.0.

The third light phase is withdrawn from third separation zone 178 through a conduit 180 and introduced into a third flash zone 182. In third flash zone 182, the third light phase is flashed to provide at least one overhead stream comprising third extraction solvent and at least one other stream comprising heavy coal liquefaction products. The overhead stream is withdrawn from third flash zone 182 through a conduit 188 for recycle to fourth mixing zone 172 to provide at least a portion of the extraction solvent necessary to effect the subsequent separation of the second heavy phase in third separation zone 178. The heavy coal liquefaction products are withdrawn from third flash zone 182 through a conduit 184 for recovery as a product. A portion of a heavy coal liquefaction products including substantially nondistillable coal-derived compounds comprising heat labile homocyclics and heterocyclics can be withdrawn from conduit 184 through a conduit 186 for recycle, either with or without additional hydrogenation treatment, to supplant a portion of the distillable solvent in liquefaction zone 16 (see FIG. 1).

In an alternate embodiment of the invention (not shown) the third light phase can be introduced into a fourth separation zone. The fourth separation zone is maintained at a temperature level above the temperature level in third separation zone 178 and at an elevated pressure level. Preferably, the pressure level is substantially the same as the pressure level in third separation zone 178 or slightly greater. The temperature level in the fourth separation zone is sufficiently greater than the temperature in third separation zone 178 to cause the third light phase to separate into a fourth light phase comprising third extraction solvent and a fourth heavy phase comprising heavy coal liquefaction products and some third extraction solvent. The fourth light phase then is withdrawn from the fourth separation zone and recycled to provide at least a portion of the third extraction solvent introduced into fourth mixing zone 172. The fourth heavy phase can be recovered as a product of the process or recycled as previously described to supplant a portion of the liquefaction solvent. The fourth heavy phase also can be flashed or subjected to steam stripping to remove any remaining third extraction solvent before recycle in the process.

The third heavy phase is withdrawn from third separation zone 178 through a conduit 190 and introduced into a fourth flash zone 192. In fourth flash zone 192, the third heavy phase is reduced in pressure by flashing to provide at least one overhead stream comprising third extraction solvent and one other stream comprising insoluble residue. The overhead stream is withdrawn from fourth flash zone 192 through a conduit 196 for recovery. The recovered extraction solvent can be recycled to the third mixing zone or fractionated to separate any other fluids that also may be present therefrom for separate recovery. The insoluble residue is withdrawn from fourth flash zone 192 through a conduit 194 for disposal or other treatment (not shown).

In an alternate embodiment of the invention (not shown), the third heavy phase can be introduced into a steam stripper or any other appropriate apparatus to recover the third extraction solvent, and any other separable products which may be present, from the insoluble residue.

To further illustrate the process of the present invention, and not by way of limitation, the following example is provided.

EXAMPLE III

A particulate coal feed comprising Kentucky No. 9 & 14 coal continuously is contacted with a solvent comprising a 500° F. to 900° F. boiling-range coal-derived hydrocarbon fraction in a ratio of solvent to feed of 2:1 and introduced into liquefaction zone 16 (see FIG. 1). The mixture is solubilized at a pressure level of about 1200 psig., a temperature level of about 825° F. and a space rate of 50 pounds per hour per cubic foot in the presence of hydrogen to produce liquefaction products.

The coal liquefaction products and solvent are introduced into distillation zone 32 wherein at least a portion of the solvent and distillable coal liquefaction products are separated from the remaining substantially nondistillable coal liquefaction products. The solvent is recycled to contact additional coal feed. The quantity of solvent recovered from the coal liquefaction products is less than that introduced into the liquefaction zone.

The substantially nondistillable coal liquefaction products are withdrawn from distillation zone 32, mixed with a first extraction solvent comprising carbon dioxide in a ratio of about 3 parts by weight of extraction solvent to one part by weight of coal liquefaction products. The mixture then is introduced into first separation zone 142 (see FIG. 2). First separation zone 142 is maintained at a temperature level of about 100° F. and a pressure level of about 1700 psig. which corresponds to a reduced temperature of the first extraction solvent of about 1.02 and a reduced pressure of the first extraction solvent of about 1.6. The control of the temperature and pressure conditions causes a separation of the mixture into a substantially solids-free product and a solids-containing product. The substantially solids-free product is withdrawn from first separation zone 142, flashed to remove a substantial portion of the first extraction solvent and the remainder is a product comprising light coal liquefaction products. The solids-containing product is withdrawn from first separation zone 142 and introduced into third mixing zone 154.

In mixing zone 154, the solids-containing product is contacted with a second extraction solvent comprising cyclohexane in sufficient quantity to provide a ratio by weight of extraction solvent to coal liquefaction products of about 2:1 to form a mixture. The mixture then is introduced into second separation zone 160 which is maintained at a temperature level of about 475° F. and a pressure level of about 750 psig. These conditions correspond to a reduced temperature of the second extraction solvent of about 0.94 and a reduced pressure of the second extraction solvent of about 1.27. The control of the temperature and pressure conditions causes a separation of the mixture within second separation zone 160 into a second light phase comprising intermediate coal liquefaction products and second extraction solvent and a second heavy phase comprising insoluble residue and any remaining coal liquefaction products. The second light phase is withdrawn from second separation zone 160, flashed to remove a substantial portion of the second extraction solvent and the remainder is recovered as a product. The second heavy phase is withdrawn from second separation zone 160 and introduced into a fourth mixing zone 172.

In fourth mixing zone 172, the second heavy phase is contacted with a third extraction solvent comprising quinoline in sufficient quantity to provide a ratio by weight of extraction solvent to coal liquefaction products of about 2:1 to form another mixture. This mixture then is introduced into a third separation zone 178 which is maintained at a temperature level of about 800° F. and a pressure level of about 1000 psig.

The conditions correspond to a reduced temperature of the third extraction solvent in third separation zone 178 of about 0.88 and a reduced pressure of the third extraction solvent of about 1.2. The control of the temperature and pressure conditions causes a separation of the mixture into a third light phase comprising heavy coal liquefaction products and third extraction solvent and a third heavy phase comprising insoluble residue and some third extraction solvent.

The third light phase is withdrawn from third separation zone 178 and flashed to remove a substantial portion of the third extraction solvent. The remainder of the third light phase is recovered as a product. A portion of the recovered heavy coal liquefaction products then are admixed with a portion of the light coal liquefaction products in a ratio by weight of 3:1 and the mixture is recycled to provide additional solvent for contacting the coal feed along with the distilled solvent.

The third heavy phase is withdrawn from third separation zone 178 and flashed to remove at least a portion of any third extraction solvent for recovery.

The coal feed thereafter is solubilized, employing at least a portion of the substantially nondistillable coal-derived solvent of the present invention, to produce coal liquefaction products. The coal liquefaction products are produced in a yield comparable to that produced with the original liquefaction solvent.

While the subject invention has been described with respect to what are considered to be the preferred embodiments, it is to be understood that while particular reference has been made to practice of the present invention employing three separate extraction solvents in three separation zones that the process of this invention can be used to separate a feed of coal liquefaction products into any number of fractions by using two, four, eight, or any number of different extraction solvents in the manner hereinbefore disclosed. To effect such multiple separations, each successive extraction solvent should contain a different number of carbon atoms than the preceeding extraction solvent, while the total number of carbon atoms in the extraction solvent remains less than the number present in the coal liquefaction solvent. For example, each successive extraction solvent should have (i) a decreasing number of carbon atoms to provide the successively lighter solvents for the embodiment of the present process illustrated in FIG. 1 and (ii) an increasing number of carbon atoms to provide the successively heavier solvents for the embodiment of the process illustrated in FIG. 2. Further, it is to be understood that the various extraction solvents can comprise a mixture of fluids in which case the number of carbon atoms in the fluid mixture is represented by the average number of carbon atoms which would be contained in a single fictional fluid based upon the relative contribution of each of the individual components. For example, one fluid having a total of 16 carbon atoms or substituted carbon atoms comprising 40 percent of a mixture and a second fluid having a total of 13 carbon atoms or substituted carbon atoms comprising the remainder of the mixture would correspond to a fictional fluid having a total of approximately 15 carbon atoms for the purposes of the present invention. Thus, it is to be understood that changes or modifications can be made in the disclosed process without departing from the spirit or scope of the invention as defined by the following claims.

What is claimed is:

1. In a coal liquefaction process wherein a liquefaction solvent that is at least partially distillable is used in a liquefaction zone to yield a product from which a slurry is recovered that comprises distillable and substantially nondistillable coal liquefaction products and an insoluble residue, the improvement which comprises:

contacting said slurry with a first extraction solvent comprising a polycyclic aromatic hydrocarbon containing at least one less substituted or unsubstituted carbon atom than said liquefaction solvent at a first elevated temperature level and pressure level such that the reduced temperature of said first extraction solvent is greater than about 0.7 and the reduced pressure of said first extraction solvent is greater than about 0.4 to effect a separation of said slurry into a substantially solids-free fraction comprising coal liquefaction products and first extraction solvent and a solids-containing fraction;

separating at least a portion of said first extraction solvent from said substantially solids-free fraction to provide a first extraction solvent-lean coal liquefaction product fraction;

contacting said first extraction solvent-lean coal liquefaction product fraction with a second extraction solvent having at least one less substituted or unsubstituted carbon atom than said first extraction solvent at a second elevated temperature level and pressure level such that the reduced temperature of said second extraction solvent is greater than about 0.7 and the reduced pressure of said second extraction solvent is greater than about 0.4 to effect a separation of said coal liquefaction products into a second light phase and a second heavy phase comprising substantially nondistillable coal-derived compounds at least a portion of which are capable of functioning as a coal solvent and some second extraction solvent;

recovering said substantially nondistillable coal-derived compounds; and introducing at least a portion of said substantially nondistillable coal-derived compounds into said liquefaction zone to supplant a portion of said liquefaction solvent in said liquefaction process.

2. The process of claim 1 wherein said first extraction solvent comprises a polycyclic aromatic hydrocarbon containing at least two fused benzene rings.

3. The process of claim 1 wherein the conditions of temperature and pressure at which the first extraction solvent contacts the slurry are such that the reduced temperature of said first extraction solvent is in the range of from about 0.7 to about 1.5 and the reduced pressure is in the range of from about 0.4 to about 10.

4. The process of claim 1 wherein the conditions of temperature and pressure at which the first extraction solvent contacts the slurry are such that the reduced temperature of said first extraction solvent is in the range of from about 0.8 to about 1.25 and the reduced pressure is in the range of from about 0.4 to about 5.0.

5. The process of claim 1 wherein the second extraction solvent contains at least one less benzene ring than the first solvent.

6. The process of claim 1 wherein separating said first extraction solvent from said substantially solids-free fraction is defined further as effected by flashing.

7. The process of claim 1 wherein the second elevated temperature level is a temperature greater than the first elevated temperature level.

8. The process of claim 1 wherein the conditions of temperature and pressure at which the second extraction solvent contacts said first extraction solvent-lean coal liquefaction product fraction are such that the reduced temperature of said second extraction solvent is in the range of from about 0.7 to about 1.5 and the reduced pressure is in the range of from about 0.4 to about 10.

9. The process of claim 1 wherein the conditions of temperature and pressure at which the second extraction solvent contacts said first extraction solvent-lean coal liquefaction product fraction are such that the reduced temperature of said second extraction solvent is in the range of from about 0.8 to about 1.25 and the reduced pressure is in the range of from about 0.4 to about 5.0.

10. The process of claim 1 defined further to include the steps of:

separating at least a portion of said second extraction solvent from said second light phase to provide a second extraction solvent-lean coal liquefaction product fraction;

contacting said second extraction solvent-lean coal liquefaction product fraction with a third extraction solvent having at least one less substituted or unsubstituted carbon atom than said second extraction solvent at a third elevated temperature level and pressure level such that the reduced temperature of said third extraction solvent is greater than about 0.7 and the reduced pressure of said third extraction solvent is greater than about 0.4 to effect a separation of said second solvent-lean coal liquefaction product fraction into a third light phase and a third heavy phase;

recovering said third heavy phase;

increasing the temperature level of said third light phase to a fourth temperature level above said third temperature level at which said third light phase is formed to effect a separation of said third light phase into a fourth light phase comprising said third extraction solvent and a fourth heavy phase;

recovering said fourth heavy phase; and recycling said fourth light phase to provide at least a portion of said third extraction solvent for contacting the second solvent-lean coal liquefaction product fraction.

11. The process of claim 10 wherein the third elevated temperature level and pressure level is above the critical temperature and pressure of the third extraction solvent.

12. The process of claim 1 wherein the second elevated temperature level and pressure level is above the critical temperature and pressure of the second extraction solvent.

13. The process of claim 1 defined further to include the step of:

hydrotreating at least a portion of said substantially nondistillable coal-derived compounds prior to introduction into said liquefaction zone.

14. In a coal liquefaction process wherein a liquefaction solvent that is at least partially distillable is used in a liquefaction zone to yield a product from which a slurry is recovered that comprises distillable and substantially non-distillable coal liquefaction products and an insoluble residue, the improvement which comprises:

contacting said slurry with a first extraction solvent comprising a fluid containing at least one less substituted or unsubstituted carbon atom than said liquefaction solvent at a first elevated temperature level and pressure level such that the reduced temperature of said first extraction solvent is greater than about 0.7 and the reduced pressure of said first extraction solvent is greater than about 0.4 to effect a separation of said slurry into a first light phase comprising at least a portion of said distillable and substantially nondistillable coal liquefaction products and first extraction solvent and a first heavy phase comprising insoluble residue, any remaining substantially nondistillable coal liquefaction products and some first extraction solvent;

contacting said first heavy phase with a second extraction solvent comprising a fluid having at least one more substituted or unsubstituted carbon atom than said first extraction solvent and at least one less substituted or unsubstituted carbon atom than said liquefaction solvent at a second elevated temperature level and elevated pressure level such that the reduced temperature level of said second extraction solvent is greater than about 0.7 and the reduced pressure of said second extraction solvent is greater than about 0.4 to effect a separation of at least a portion of any remaining substantially nondistillable coal liquefaction products in said first heavy phase into a second light phase comprising substantially nondistillable coal liquefaction products including substantially nondistillable coal-derived compounds at least a portion of which are capable of functioning as a coal solvent and second extraction solvent and a second heavy phase comprising insoluble residue, any remaining coal liquefaction products and some second extraction solvent; and introducing at least a portion of said substantially nondistillable coal-derived compounds into said liquefaction zone to supplant a portion of said liquefaction solvent in said liquefaction process.

15. The process of claim 14 defined further to include the step of:

hydrotreating at least a portion of said substantially nondistillable coal-derived compounds prior to introduction into said liquefaction zone.

16. The process of claim 14 wherein the second elevated temperature level and pressure level are above the critical temperature and pressure of the second extraction solvent.

17. The process of claim 14 defined further to include the steps of:

heating said second light phase to a temperature level above the second temperature level while maintaining said second light phase at an elevated pressure level to effect a separation of said second light phase into a third light phase comprising second extraction solvent and a third heavy phase comprising substantially nondistillable coal liquefaction products including said substantially nondistillable coal-derived compounds; and introducing at least a portion of said substantially nondistillable coal-derived compounds of said coal liquefaction products into said liquefaction zone to supplant a portion of said liquefaction solvent.

18. The process of claim 14 wherein the conditions of temperature and pressure at which the first extraction solvent contacts the slurry are such that the reduced temperature of said first extraction solvent is in the range of from about 0.9 to about 1.5 and the reduced pressure is in the range of from about 0.4 to about 10.

19. The process of claim 14 wherein the conditions of temperature and pressure at which the first extraction solvent contacts the slurry are such that the reduced temperature of said first extraction solvent is in the range of from about 1.0 to about 1.25 and the reduced pressure is in the range of from about 0.4 to about 5.

20. The process of claim 14 wherein the conditions of temperature and pressure at which the second extraction solvent contacts the first heavy phase are such that the reduced temperature of said second extraction solvent is in the range of from about 0.7 to about 1.5 and the reduced pressure is in the range of from about 0.4 to about 10.

21. The process of claim 14 wherein the conditions of temperature and pressure at which the second extraction solvent contacts the first heavy phase are such that the reduced temperature of said second extraction solvent is in the range of from about 0.8 to about 1.25 and the reduced pressure is in the range of from about 0.4 to about 5.

* * * * *